United States Patent [19]

Wise

[11] 4,166,039

[45] Aug. 28, 1979

[54] DETERGENT COMPOSITION AND PROCESS

[75] Inventor: Rodney M. Wise, Cincinnati, Ohio

[73] Assignee: The Proctor & Gamble Company, Cincinnati, Ohio

[21] Appl. No.: 589,116

[22] Filed: Jun. 23, 1975

Related U.S. Application Data

[63] Continuation-in-part of Ser. No. 406,412, Oct. 15, 1975, abandoned.

[51] Int. Cl.[2] ..... C11D 1/72; C11D 3/075; C11D 7/02

[52] U.S. Cl. ..... 252/110; 252/89; 252/108; 252/109; 252/133; 252/135; 252/140; 252/526; 252/527; 252/528; 252/531; 252/532; 252/539; 252/540; 252/545; 252/546; 252/547; 252/550; 252/551; 252/558; 252/559; 252/89.1; 252/174.14; 252/174.21; 252/174.17; 252/174.25

[58] Field of Search ..... 252/89, 131–134, 252/135, 140, 534, 532, 539, 540, 108, 526, 528, 527, 110

[56] References Cited

U.S. PATENT DOCUMENTS

| | | | |
|---|---|---|---|
| 1,813,247 | 7/1931 | Merlub-Sobel | 252/131 |
| 1,943,519 | 1/1934 | Denning | 252/140 |
| 2,344,268 | 3/1944 | Rench | 252/163 |
| 2,491,051 | 12/1949 | McCarter | 252/89 |
| 2,594,257 | 4/1952 | Durgin | 252/140 |
| 2,594,258 | 4/1952 | Durgin | 252/140 |
| 2,770,600 | 11/1956 | Ricciardi | 252/131 |
| 3,764,541 | 10/1973 | Kaneko | 252/89 |
| 3,769,222 | 10/1973 | Yurko et al. | 252/89 |
| 3,838,072 | 9/1974 | Smith et al. | 252/540 |
| 3,865,754 | 2/1975 | Norris et al. | 252/532 |

FOREIGN PATENT DOCUMENTS 579835 8/1946 United Kingdom .

OTHER PUBLICATIONS

Schott, H., "Interaction of Nonionic Detergents and Swelling Agents", *Rolloid-Zeitschrift*, 199(2), 158–169, (1964).

*Primary Examiner*—P. E. Willis, Jr.
*Attorney, Agent, or Firm*—Robert B. Aylor; Richard C. Witte; Thomas H. O'Flaherty

[57] ABSTRACT

Improved granular detergent compositions comprising a nonionic surfactant are prepared by incorporating the nonionic surfactant with a kaolinite or bentonite clay, preferably at an elevated temperature. The choice of clay is dependent on builder type, kaolinite clays being used in non-phosphate detergent compositions, while bentonite clays are used in phosphate-containing formulations. Incorporation of these clays gives homogeneous detergent slurries and superior properties of the resulting spray-dried detergent granules.

21 Claims, No Drawings

DETERGENT COMPOSITION AND PROCESS

CROSS REFERENCE TO RELATED APPLICATION

This application is a continuation-in-part of copending application U.S. Patent Application Ser. No. 406,412; filed Oct. 15, 1973; entitled DETERGENT COMPOSITION AND PROCESS; inventor: Rodney M. Wise, now abandoned.

BACKGROUND OF THE INVENTION

The present invention relates to spray-dried detergent compositions comprising a nonionic surfactant which is intimately associated with a kaolinite or bentonite clay, and processes for preparing same. The use of kaolinite or bentonite clay in a detergent crutcher mix, in the manner disclosed hereinafter, provides a homogeneous, non-oily mix which can be conveniently spray dried. Detergent granules spray dried from crutcher mixes prepared in the manner of this invention have improved properties over spray-dried detergent granules containing nonionic surfactants heretofore known.

In the preparation of spray-dried detergent granules an aqueous mixture of the various components of the granules (the crutcher mix) is sprayed or otherwise introduced into what is essentially a drying tower. As the droplets of the crutcher mix proceed through the drying tower, the water is flashed off and solid or semi-porous detergent granules are secured. The advantage of spray-dried detergent granules over granules obtained by simple dry mixing of the individual ingredients is their homogeneity. That is to say, each granule contains the various ingredients in the same ratios and proportions introduced into the original crutcher mix. This provides obvious advantages over simple dry-mixed detergent formulations, inasmuch as dry mixing can result in inhomogeneity in the final detergent formulation such that the user is never certain of the composition of any given portion of such products.

In order to provide a homogeneous spray-dried granule it is necessary that the crutcher mix, itself, be substantially homogeneous. In some instances, a crutcher mix may be a homogeneous solution. However, in order to provide a crutcher solution, excessive amounts of water are needed to dissolve all the components. Use of excessive amounts of water requires additional drying capacity in the spray-dry tower and is not economically attractive. For the most part, the cructher mixes employed in the preparation of spray-dried detergent compositions are semi-dissolved aqueous slurries of the various components desired in the final spray-dried granules. This causes problems in maintaining the homogeneity of such mixes.

The introduction of alkoxylated nonionic surfactants into an aqueous detergent crutcher mix adds a new dimension to the problems encountered with maintaining a relatively homogeneous mixture. Nonionic surfactants tend to be oily and exist as a separate phase within the crutcher mix. Such non-homogeneity in the crutcher mix is intolerable when preparing a homogeneous spray-dried detergent granule. Of course, the separation problem is accentuated by the increased amounts of nonionics used in modern detergent compositions.

A variety of methods have heretofore been employed to provide the requisite homogeneity of crutcher mixes containing nonionic surfactants. Perhaps the most widely used method involves the addition of certain alkyl phosphate esters to the crutcher mix. While the exact mechanism is not known, the phosphate esters appear to "couple" the nonionic to the other components of the mix, thereby providing the requisite homogeneity.

The use of phosphate esters in crutcher mixes is not without its drawbacks. While effective for the intended puspose, the phosphate esters tend to leave a residual greasy feel on the surface of the spray-dried granules. Moreover, the introduction of phosphorus in a detergent composition, in any form, may be undesirable when such detergent compositions are used in areas of the country having incompletely treated sewage. Accordingly, it is desirable to provide an alternate method for securing a substantially homogeneous crutcher mix containing relatively large amounts of nonionic surfactants.

It has now been found that kaolinite and bentonite clays, when employed in combination with an alkoxylated nonionic surfactant in the manner hereinafter disclosed, provide stable, homogeneous crutcher mixes. Such stabilized crutcher mixes do not experience separation of an oily phase comprising the nonionic surfactant. Moreover, the spray-dried detergent granules prepared from the crutcher mixes herein have unexpected advantages over other spray-dried granules containing nonionic surfactants, but without added kaolinite or bentonite clays.

The use of clays in detergent compositions for a variety of purposes is well known; see, for example, U.S. Pat. Nos. 2,118,310; 2,205,021; 2,296,639; 2,344,268; 2,491,051; German Pat. No. 361,520; and British Pat. Nos. 469,344; and 579,835.

More particularly, Schwartz, Perry and Birch, "Surface Active Agents and Detergents" Vol. II, Interscience Publishers, Inc., 1958 at page 299, broadly teach that clays have been used to sorb the normally liquid nonionic detergents used in powdered household detergent formulations. U.S. Pat. Nos. 2,594,257 and 2,594,258 specifically relate to the sorption of nonionic surfactants of various types on sorbents such as kieselguhr and attapulgite, and the use of such compositions in dry-mixed detergent compositions. The sorbed nonionics are taught not to "bleed" from such compositions.

The prior art teachings regarding the use of clay to sorb nonionic surfactants in detergent compositions are useful for formulating dry mixtures, but the use of clays to provide homogeneous crutcher mixes suitable in spray-drying processes has not been disclosed heretofore.

Moreover, the problem of heterogeneous crutcher mixes is not solved by a random selection of sorbent clay carriers for the nonionics. The water and alkalinity of the crutcher mix tend to displace the nonionics from most carrier materials, resulting in phase separation. Other surfactants which may be present in the crutcher mix, especially the anionics, aid in this displacement and add to the problem.

In contrast with other clays, the kaolinite and bentonite employed as a sorbent carrier for nonionic surfactants in the particular manner disclosed hereinafter provide a stable, homogeneous crutcher mix. This is especially surprising with kaolinite since this clay is not recognized as being a useful adjuvant with most nonionic surfactants in aqueous media and, hence, is not generally used in combination therewith.

In addition, it has been found that the spray-dried detergent granules prepared in the manner disclosed herein have desirable properties over spray-dried granules containing nonionic surfactants heretofore prepared.

It is an object of this invention to provide homogeneous crutcher mixes containing substantial quantities of nonionic surfactants without the need for phosphate ester couplers.

It is another object herein to provide improved spray-dried detergent granules containing kaolinite or bentonite clay and substantial quantities of nonionic surfactants, and improved processes for preparing same.

These and other objects are obtained herein as will be seen by the following disclosure.

SUMMARY OF THE INVENTION

The present invention encompasses processes for preparing homogeneous crutcher mixes containing a substantial quantity of alkoxylated nonionic surfactants. By a "substantial" quantity of nonionic surfactant is meant amounts of nonionic surfactant of about 4% by weight, and greater, of the total crutcher mix. The formation of a substantially homogeneous crutcher mix in the manner disclosed herein provides a means for preparing homogeneous spray-dried detergent granules containing nonionic surfactants.

In its broadest method aspect, the instant invention encompasses a process for preparing a homogeneous, aqueous crutcher mix containing a substantial amount of a nonionic surfactant, comprising adding a naturally derived clay mineral selected from the group consisting of kaolinites having a mean particle size of not more than about 1 micron and bentonites having a mean particle size of not more than about 75 microns said clay minerals being substantially free of organic modifying groups together with said nonionic surfactant to said crutcher mix at a weight ratio of nonionic surfactant:-clay of from about 20:1 to about 1:2 (preferably 3:1) and maintaining the crutcher mix at a temperature of at least 150° F. (preferably 150° F. to 210° F.). The hot mix is blended until homogeneous and then dried, preferably spray-dried, to provide homogeneous detergent granules.

In its compositional aspect, the invention encompasses homogeneous granular (preferably spray dried) detergent compositions, consisting essentially of:

(a) from about 0.5% to about 40% (preferably 1% to 10%) by weight of a naturally derived clay mineral selected from the group consisting of kaolinites having a mean particle size of not more than about 1 micron and bentonites having a mean particle size of not more than about 75 microns said clay minerals being substantially free of organic modifying groups; and (b) from about 2% to about 60% (preferably 5% to 35%) of an alkoxylated nonionic surfactant at a weight ratio of said surfactant to said clay in the range of from 20:1 to 1:2, preferably 6:1 to 1:2, most preferably 3:1 to 1:1, said surfactant preferably being combined with said clay at a temperature of at least 150° F. (preferably 150° F. to 180° F.); and (c) from 0% to about 50% (preferably about 5% to 50%) by weight of a detergency builder, provided that where said detergency builder is a phosphate salt, said clay is a bentonite clay and where said detergency builder is non-phosphatic in character, said clay is a kaolinite clay.

In their most preferred embodiment, the compositions herein are prepared by mixing the kaolinite or bentonite clay and nonionic at a temperature of at least 150° F. prior to addition to the hot aqueous crutcher mix and spray drying. The compositions can optionally contain additional surfactants, especially the anionics, as well as other ingredients commonly employed in commercial detergent compositions.

DETAILED DESCRIPTION OF THE INVENTION

The non-homogeneity problem with crutcher mixes containing alkoxylated nonionic surfactants depends on at least two factors: (a) the amount of nonionic surfactant present in the mix; and (b) the presence or absence of anionic surfactants. Moreover, when anionic surfactants are present in the mix, the ratio of nonionic surfactant:anionic surfactant can affect the procedures required to establish a homogeneous system.

Crutcher mixes containing minor amounts (ca. <4%) of alkoxylated nonionic surfactants can be maintained in a relatively homogeneous state by simple mechanical agitation. However, such mixes are only useful for preparing dry detergent compositions containing minor amounts of the nonionics. While kaolinite or bentonite clay can be employed to advantage in crutcher mixes containing minor amounts of nonionic surfactants, the clay is particularly useful when a substantial quantity of nonionic is being used in the mix.

Modern detergent compositions usually contain a mixture of various surfactants. Detergent compositions containing anionic surfactants, for sudsing and particulate soil removal, admixed with nonionic surfactants, for greasy soil removal, are particularly advantageous. The preparation of homogeneous granular detergent compositions containing mixtures of nonionic and anionic surfactants requires the use of crutcher mixes containing mixtures of said surfactant types.

The presence of anionic surfactants in aqueous crutcher mixes containing nonionic surfactants adds to the problem of maintaining the homogeneity of the mix. This problem is caused by certain concentrations of anionic surfactants which are insufficient to aid in maintaining homogeneity of the mixes, but which are sufficient to disrupt the clay-nonionic attraction.

By the present process, the addition of kaolinite or bentonite clay to an aqueous crutcher mix establishes and maintains the desired homogeneity in the presence of substantial quantities of nonionic surfactants, even in the presence of anionic surfactants. The details of the process will vary somewhat, depending on the presence or absence of anionic surfactant and the nonionic:anionic ratio.

In general terms, the present process comprises adding from 0.5% to 40% by weight of kaolinite or bentonite clay and about 2% to about 60% by weight of a nonionic surfactant, at a nonionic:clay weight ratio of 6:1 to 1:2, to a crutcher mix which is maintained at a temperature of at least 150° F. In its simplest aspect, the crutcher mix can comprise water. More often, the mix will also contain additional materials such as various detergent compounds, builders, soil release polymers, soil suspending agents, and the like, commonly found in commercial detergent compositions. The additional materials do not interfere with the process herein but the builder type, ie phosphate or non-phosphate, determines the clay type which is used.

Whilst the Applicant does not wish to be bound by theory, it is believed that the selectivity of the clay type in the presence of different detergency builders is associated with the lattice structure of the clay. Kaolinites are two-layer clays having a sheet structure composed of units of one layer of alumina octahedrons. Adjacent sheets are bonded by weak Van der Waals forces. Kaolinites are non-expanding and electrically neutral in character.

In contrast clay minerals sold commercially as bentonites are predominantly of the three-layer expanding smectite type and consist mainly of montmorillonites. The latter clays have sheet structures composed of two layers of silica tetrahedra and a central alumina dioctahedral layer which is substituted by other di- or trivalent metals. Bentonites are negatively charged in aqueous suspension and this charge increases with increasing substitution of the $Al^{+++}$ ions in the lattice so that their charge density is much higher than that of the kaolinites. It is this feature which is believed to be responsible for the difference in behavior of kaolinite and bentonite clays with phosphate and non-phosphate builders. The higher negative charge density of the bentonites is thought to prevent phosphate interaction with metal ions in the clay lattice.

In a preferred mode, the nonionic surfactant and clay are pre-slurried at the weight ratios disclosed above, at a temperature of at least about 150° F., before being added to the aqueous crutcher mix. Pre-slurrying at elevated temperatures appears to permit the establishment of attractive forces between the nonionic and the water-insoluble clay particles. When prepared in this manner, the nonionic is not displaced from the clay by the water present in the hot crutcher mix. Moreover, even in the presence of anionic surfactants which can be optionally added to the crutcher, the nonionic remains associated with the clay particles.

Accordingly, a preferred mode of the present invention encompasses a process for preparing a homogeneous detergent crutcher mix containing a substantial quantity of an alkoxylated nonionic surfactant, comprising:

(a) admixing a nonionic surfactant and a kaolinite clay mineral of particle size less than about 1μ or a bentonite clay mineral of particle size less than about 5μ at a weight ratio of nonionic surfactant:-clay mineral of from about 6:1 to about 1:2 to provide a hot slurry having a temperature of at least about 150° F. (preferably 150° F. to 180° F.); and (b) admixing the hot slurry of step (a) with an aqueous detergent crutcher mix which is also maintained at a temperature of at least 150° F. (preferably 150° F. to 180° F.).

The hot mix of step (b) is then dried, preferably by spray-drying, to provide a granular detergent composition.

When there are to be no anionic surfactants present in the crutcher mix, there is no advantage in slurrying the clay and nonionic at an elevated temperature, and they can simply be added to the crutcher mix separately. The nonionic will be attracted to the clay from the aqueous medium. Alternatively, the nonionic and clay can be pre-slurried at ambient temperatures (preferably 150° F. and higher) and added to the crutcher mix. The crutcher mix can be preheated to the 150° F. to 180° F. temperature range, or can be heated after addition of the clay and nonionic surfactant.

When minor proportions of anionic surfactants are to be present in the crutcher mix, i.e., at nonionic:anionic weight ratios of less than about 1:3, the nonionic surfactant must be pre-slurried with the clay in the above-disclosed proportions prior to admixing with the hot crutcher mix. The pre-slurry can be prepared at ambient temperature and added to the hot mix, but is preferably prepared and added at temperatures of 150° F., and above, as set forth hereinabove.

When major proportions of anionic surfactants are to be present in the crutcher mix, i.e., at nonionic:anionic weight ratios more than about 1:3, the predominance of anionic surfactant aids in providing crutcher mix homogeneity. In such cases, the clay and nonionic usually can simply be added to the crutcher mix. Again, however, the hereinabove-disclosed preferred procedure of adding a hot pre-slurry of the nonionic surfactant and kaolinite or bentonite clay to the hot crutcher mix results in superior homogeneity of the mix.

From the foregoing it is seen that the present process can be varied in its details, depending on the presence or absence of anionic surfactants in the crutcher mix, and the proportions thereof.

The various processing aspects and ingredients employed herein are set forth in detail below. As noted hereinabove, the crutcher mix can simply consist of water to which the nonionic and clay are added, either separately, or as a pre-slurry. More often, the crutcher mix comprises water and one or more detergents, builders and the like.

A. Crutcher Mix

The crutcher mixes employed in the process of the present invention can conveniently comprise an aqueous slurry containing from about 15% to about 50% (preferably about 25% to about 40%) by weight of water, from about 1% to about 40% (preferably from about 5% to about 20%) by weight of a water-soluble organic detergent component as hereinafter described, and from about 10% to about 80% (preferably from about 30% to about 60%) by weight of the optional builder and adjunct materials hereinafter disclosed.

Use of the foregoing crutcher mixes in combination with the kaolinite or bentonite clays useful in the invention and the nonionic surfactant results in the formation of substantially homogeneous mixes suitable for preparing homogeneous powdered and granular detergent compositions. Of course, such detergent compositions contain the various ingredients originally present in the crutcher mix. However, the final concentrations of such ingredients in the dry detergent compositions may differ somewhat from their concentrations in the crutcher, inasmuch as the clay and nonionic or a mixture thereof is added to the crutcher and a major portion of the water is removed on drying.

Detergent Component

The crutcher mixes of the instant invention (as well as the dry detergent compositions prepared therefrom) can contain all manner of anionic, semi-polar, zwitterionic and amphoteric organic, water-soluble detersive surfactant (detergent) compounds, inasmuch as the nonionic surfactants are compatible with all such materials in the presence of the appropriate clay. A typical listing of the classes and species of detergent compounds useful herein (exclusive of nonionics) appears in U.S. Pat. No.

3,664,961, incorporated herein by reference. The following list of detergent compounds and mixtures which can be used in the instant compositions and processes is representative of such materials, but is not intended to be limiting.

Water-soluble salts of the higher fatty acids, i.e., "soaps" are useful as the detergent component herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergents includes water-soluble salts, particularly the alkali metal, ammonium and alkylolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which can be used in the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkyl benzene sulfonates in which the average of the alkyl groups is about 13 carbon atoms, abbreviated as $C_{13}$ LAS.

Other anionic detergent compounds herein include the sodium alkyl glyceryl ether sulfonates, especially those ethers of higher alcohols derived from tallow and coconut oil; sodium coconut oil fatty acids monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Semi-polar detergents useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water solubilizing group.

Other useful detergent compounds herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Specific preferred detergents for use herein include: sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)hexanoate; dodecyl dimethyl amine oxide; coconut alkyl dimethyl amine oxide; and the water-soluble sodium and potassium salts of higher fatty acids containing 8 to 24 carbon atoms.

It is to be recognized that any of the foregoing detergents can be used separately herein or as mixtures. Examples of preferred detergent mixtures herein are as follows.

As especially preferred alkyl ether sulfate detergent component useful in the instant compositions and processes is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide.

Specifically, such preferred mixtures comprise from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds and from about 0.1% to 5% by weight of mixture of $C_{18-19}$ compounds. Further, such preferred alkyl ether sulfate mixtures comprise from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

Examples of alkyl ether sulfate mixtures falling within the above-specified ranges are set forth in Table I.

TABLE I

| MIXTURE CHARACTERISTIC | ALKYL | ETHER | SULFATE | MIXTURE |
|---|---|---|---|---|
| Average carbon chain | I | II | III | IV |
| Length (No. C Atoms) | 14.86 | 14.68 | 14.86 | 14.88 |
| 12–13 carbon atoms (wt. %) | 4% | 1% | 1% | 3% |
| 14–15 carbon atoms (wt. %) | 55% | 65% | 65% | 57% |
| 16–17 carbon atoms (wt. %) | 36% | 33% | 33% | 38% |
| 18–19 carbon atoms (wt. %) | 5% | 1% | 1% | 2% |
| Average degree of ethoxylation (No. Moles EO) | 1.98 | 2.25 | 2.25 | 3.0 |
| 0 moles ethylene oxide (wt. %) | 15% | 21% | 22.9% | 18% |
| 1–4 moles ethylene oxide (wt. %) | 63% | 59% | 65% | 55% |
| 5–8 moles ethylene oxide (wt. %) | 21% | 17% | 12% | 22% |
| 9+ moles ethylene oxide (wt. %) | 1% | 3% | 0.1% | 5% |
| Salt | K | Na | Na | Na |

Preferred "olefin sulfonate" detergent mixtures utilizable herein comprise olefin sulfonates containing from about 10 to about 24 carbon atoms. Such materials can be produced by sulfonation of α-olefins by means of uncomplexed sulfur dioxide followed by neutralization under conditions such that any sultones present are hydrolyzed to the corresponding hydroxy-alkane sulfonates. The α-olefin starting materials preferably have from 14 to 16 carbon atoms. Said preferred α-olefin sulfonates are described in U.S. Pat. No. 3,332,880, incorporated herein by reference.

Preferred α-olefin sulfonate mixtures herein consist essentially of from about 30% to about 70% by weight of water soluble salts of alkene-1-sulphonic acids, from about 20% to about 70% by weight of water soluble salts of 3-4-5-hydroxy alkane sulphonates, and from about 2% to about 15% of alkene disulphonates and hydroxy alkane disulphonates.

Adjunct Materials

The herein-disclosed crutcher mixes and the detergent compositions prepared therefrom can contain, in addition to the organic detergent compounds, all manner of detergency builders commonly taught for use in detergent compositions. Such builders can be employed in the crutcher mix at concentrations of from about 10% to about 80% by weight (preferably 30% to 60%) to yield dry detergent compositions containing from about 5% to about 50% by weight, preferably from about 10% to about 35% by weight, of said builders. Useful builders herein include any of the conventional inorganic and organic water-soluble builder salts.

Such detergency builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1, 1-diphosphonic acid and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorus builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate phloroglucinol trisulfonate, and the copolymer of maleic anhydride with vinyl methyl ether or ethylene.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in Belgian Pat. No. 798,856 issued Oct. 29, 1973, the disclosure of which is incorporated herein by reference.

Specific examples of such seeded builder mixtures comprise: 3:1 wt. mixtures of sodium carbonate and calcium carbonate having a 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

A further class of detergency builder materials useful in the present invention are insoluble sodium aluminosilicates, particularly those disclosed in Belgian Pat. No. 814,874 issued Nov. 12, 1974 and incorporated herein by reference. This discloses and claims detergent compositions containing sodium aluminosilicates of formula $$Na_z(AlO_2)_z(SiO_2)_y xH_2O$$

wherein z and y are integers of at least 6, the molar ratio of z to y is in the range from 1.0:1 to about 0.5:1 and x is an integer from about 15 to about 264, said aluminosilicates having a calcium ion exchange capacity of at least 200 mg. eq./gr. and a calcium ion exchange rate of at least about 2 grains/gallon/minute/gram. A preferred material is $Na_{12}(SiO_2.AlO_2)_{12}.27\ H_2O$.

It must be appreciated that the requirement that kaolinites be utilized in non-phosphatic compositions and bentonites in phosphate-containing formulae relates only to the situation where such detergent builder salts are incorporated in the slurry (crutcher mix) and are present in the homogeneous granular product resulting from the subsequent drying step. Simple mixtures of granular detergent builder salts with the homogeneous granular product, or mixtures resulting from subsequent processing steps in which such builder salts are co-agglomerated, tabletted, prilled or otherwise combined with the homogeneous granular products of the invention are considered as forming part of the invention. In such circumstances phosphate builders can be dry mixed or agglomerated with kaolinite-containing detergent granules and similarly bentonite-containing granules can be mixed with non-phosphate builders such as carbonates and silicates. Builder levels of from 1% to 50% by weight of the composition can be obtained by admixture.

The process herein can be successfully carried out to provide detergent compositions containing all manner of additional materials commonly found in laundering and cleaning compositions. Such additional materials can simply be included in the crutcher mix, as desired. Accordingly, the crutcher mixes (and resulting detergent compositions) herein can contain thickeners and soil suspending agents such as carboxymethylcellulose and the like. Various perfumes, optical bleaches, fillers, anti-caking agents, fabric softeners and the like can be present to provide the usual benefits occasioned by the use of such materials in detergent compositions.

Another preferred component is a hydrotrope particularly where anionic surfactants are incorporated in the detergent composition. Non-limiting examples of suitable hydrotropes are the alkali metal salts of benzene, toluene xylene and cumene sulphonic acids, particularly sodium and potassium toluene sulfonate.

Perborate bleaches commonly employed in European detergent compositions can also be present as a component of the instant detergent compositions, and are added thereto as dry admixes.

Enzymes, especially the thermally stable proteolytic and lipolytic enzymes used in laundry detergents, can be dry-mixed in the compositions herein.

It is to be recognized that all such adjuvant materials are useful, inasmuch as they are compatible in the presence of the clay and nonionic surfactant.

Gelling agents such as the amorphous silicas and the various alkyl- and hydroxyalkyl-cellulose derivatives are particularly useful adjuncts in the present compositions and processes. While such gelling agents are not particularly useful in detergent crutcher mixes at high concentrations due to the formation of intractable gelled masses, they can be employed herein in relatively low (0.1% to 3%) concentrations in the crutcher mix to provide additional advantages in the final detergent compositions. Apparently the gelling agents, whilst not being useful on their own as stabilization aids, are beneficial in combination with the clay materials by providing an additional fixative action, but without unduly thickening the crutcher mix itself. Furthermore, they also assist in preventing "bleeding" of the nonionic on prolonged storage of the detergent granules.

Suitable inorganic gelling agents which can be optionally employed in the present process include the microfine silicas such as silica gels, silica xerogels, fumed colloidal silica, and the like. Specific examples of useful organic gelling agents include the various alkyl and hydroxyalkyl, e.g., methyl, ethyl, propyl, butyl, hydroxymethyl, hydroxyethyl, hydroxypropyl and hydroxybutyl, cellulose derivatives well known in the art. Hydroxybutylcellulose and mixed hydroxypropylmethylcellulose are preferred herein.

The gelling agents can be employed in the present invention by simply adding them to the crutcher mix, either before or after addition of the clay and nonionic surfactant. Preferably, the gelling agent is added to a pre-slurry of the nonionic surfactant and clay; the resulting mixture is then added to the crutcher mix, in the manner described above.

Dried detergent compositions which are prepared using the instant process and the optional gelling agents comprise the nonionic surfactant and the kaolinite or bentonite clay in the ratios and proportions hereinabove disclosed, and from about 0.1% to about 5% by weight of said gelling agent.

B. Nonionic Surfactant Component

The nonionic surfactants employed in the present compositions and processes can be any of the detersive alkoxylated surfactants well-known in the art. In general terms, the nonionics herein are water-soluble detersive surfactants of the formula $$R—O—(C_yH_{2y}O)_a—(C_zH_{2z}O)_b—C_wH_{2w}OH$$

wherein R is selected from the group consisting of primary, secondary and branched chain alkyl hydrocarbyl moieties; primary, secondary and branched chain alkenyl hydrocarbyl moieties; and primary, secondary and branched chain alkyl- and alkenyl-substituted phenolic hydrocarbyl moieties; said hydrocarbyl moieties having a hydrocarbyl chain length of from 8 to about 20, preferably 10 to 16, carbon atoms. In the general formula for the alkoxylated nonionic surfactants herein, y and z are each integers of from 2 to about 3, preferably 2, either z or y being 2 when the other integer is 3 (i.e., excluding the all-PO surfactants); w is an integer of from 2 to about 3, preferably 2, and a and b are each integers of from 0 to about 8, the sum of a+b being in the range of from 6 to about 25, preferably 6 to 10. The formula of the surfactants herein encompasses ethylene oxide (EO) as well as mixed ethylene oxide-propylene oxide (EO-PO) alkoxylates, all of which are useful herein. The all-PO surfactants do not provide cleaning advantages in detergent compositions and are not contemplated for use herein.

Preferred nonionic surfactants used herein are the ethoxylated nonionics, both from the standpoint of availability and cleaning performance.

Specific examples of nonionic surfactants useful herein are as follows. The examples are only by way of exemplification and are not intended to be limiting of such materials.

Straight-chain, primary alcohol alkoxylates

The hexa-, hepta-, octa-, nona-, deca-, undeca-, dodeca-, tetradeca- and hexadeca-alkoxylates of n-octanol, n-decanol, n-dodecanol, n-tetradecanol, n-hexadecanol and n-octadecanol having an HLB within the range from about 11 to about 17 are useful surfactants in the context of this invention; the respective ethylene oxide condensates are the most preferred alkoxylates. Exemplary alkoxylated primary alcohols useful herein as the surfactant component of the mixtures are: n-$C_{10}$EO(6); n-$C_{10}$EO(9); n-$C_{12}$EO(9); n-$C_{14}$EO(10); n-$C_{10}$EO(10); n-$C_9$EO(9); n-$C_{16}$EO(14); and n-$C_{10}$EO(6)PO(3). The ethoxylates of mixed natural or synthetic alcohols in the "coconut" chain length range are also useful herein. Specific examples of such materials include coconutalkylEO(6) and coconutalkylEO(9).

Straight-chain, secondary alcohol alkoxylates

The hexa-, hepta-, octa-, nona-, deca-, undeca-, dodeca-, tetradeca- and hexadeca-alkoxylates of 2-decanol, 2-tetradecanol, 3-hexadecanol, 2-octadecanol, 4-eicosanol, and 5-eicosanol having an HLB within the range from about 11 to about 17 are useful surfactants in the context of this invention; the respective ethylene oxide condensates are the moxt preferred alkoxylates. Exemplary alkoxylated secondary alcohols useful herein as the surfactant component of the mixtures are: 2-$C_{10}$EO(9); 2-$C_{12}$EO(9); 2-$C_{14}$EO(10); 2-$C_{16}$EO(11); 4-$C_{20}$EO(11); 2-$C_{16}$EO(14); and 2-$C_{10}$EO(6)PO(3). The most preferred straight chain, secondary alcohol alkoxylates herein are the materials marketed under the tradename Tergitol 15-S-9 and Tergitol 15-S-7, which comprise a mixture of secondary alcohols having an average hydrocarbyl chain length of 13 carbon atoms condensed with an average of 9 and 7 moles of ethylene oxide per mole equivalent of alcohol, respectively.

Alkyl phenolic alkoxylates

As in the case of the alcohol alkoxylates, the hexa- through hexadeca-alkoxylates of alkylated phenols, particularly monohydric alkylphenols, having an HLB within the range from about 11 to about 17 are useful as the surfactant component of the instant mixtures. The respective ethylene oxide condensates are the most preferred alkoxylates. The hexa- through hexadeca-alkoxylates of p-hexaphenol, m-octylphenol, p-octylphenol, p-nonylphenol and the like are useful herein; most preferred are the ethoxylates of p-octylphenol and p-nonylphenol, inasmuch as these materials are readily available. Exemplary alkoxylated alkyl phenols useful as the surfactant component of the mixtures herein are: p-octylphenol EO(9), p-nonylphenol EO(9); p-decylphenol EO(9); o-dodecylphenol EO(10); and p-octylphenol EO(9)PO(2). The most preferred alkylphenol alkoxylates herein are p-octylphenol (nonoxyethylene) and p-nonylphenol (nonoxyethylene).

Olefinic alkoxylates

The alkenyl alcohols, both primary and secondary, and alkenyl phenols corresponding to those disclosed immediately hereinabove can be alkoxylated to an HLB within the range from about 11 to about 17 and used as the surfactant component of the instant mixtures. Typical alkenyl alkoxylates herein are 2-n-dodecenol EO(9); 3-n-tetradecenol EO(9); p-(2-noneyl)phenol EO(9-)PO(2); and 2-tetradecen-4-ol EO(9).

Branched chain alkoxylates

Branched chain primary and secondary alcohols which are available by the well known "OXO process can be alkoxylated" and employed as the surfactant component of mixtures herein. Exemplary branched-chain alkoxylates are as follows: 2-methyl-1-dodecanol EO(9); 3-ethyl-2-tetradecanol EO(9); 2-methyl-1-hexadecanol EO(9)PO(2) and the like.

The foregoing alkoxylated nonionic surfactants are useful in the present compositions and processes singly, or in combination, and the term "nonionic surfactant" encompasses mixed nonionic surfactant systems containing multiple alkoxylated nonionic surface active agents.

One mixed alkoxylated nonionic system which is particularly useful herein comprises a mixture of one or more of the foregoing detersive alkoxylated nonionic surfactants having an HLB in the range of from about 11 to 17 (preferably 12 to 15) and, as a "co-surfactant", one or more water-soluble alkoxylates having an HLB in the range of 7 to 10.5 (preferably 9 to 10.5). The two types of alkoxylated materials are combined in appropriate weight ratios to provide an overall HLB of the mixture of from about 10 to about 12.5 (preferably 10 to 12; most preferably 10.5 to 12.0). Such mixtures of nonionic surfactant and nonionic co-surfactant provide superior fabric cleaning performance and are particularly useful for removing greasy soil from polyester and cotton/polyester fabric blends. These preferred nonionic surfactant-plus-nonionic "co-surfactant" alkoxylate mixtures are more fully described in Belgian Pat. No. 149,552, issued Apr. 15, 1975, incorporated herein by reference.

A further highly preferred alkoxylated nonionic surfactant system is that disclosed and claimed in the commonly assigned copending U.S. Patent Application No. 557,217 by Jerome H. Collins, Filed Mar. 10, 1975, now abandoned, and incorporated herein by reference. This surfactant system comprises a base-catalysed primary alcohol ethoxylate having the formula $R_1$—$R_2$—O $(CH_2CH_2O)_{nav}$ H wherein $R_1$ is a linear alkyl residue and $R_2$ has the formula CH $R_3$ $CH_2$, $R_3$ being selected from hydrogen and mixtures thereof with $C_1$–$C_4$ alkyl groups there being not more than 70% by weight of said groups in the mixtures, wherein $R_1$ and $R_2$ together form an alkyl residue containing a mean of 9 to 15 carbon atoms at least 65% by weight of said residue having a chain length within ±1 carbon atom of the mean, wherein $3.5 < n_{av} < 6.5$. Such a system is also characterised by an unethoxylated alcohol content of <5 wt% and by at least 63 wt% of ethoxylates containing two to seven ethylene oxide groups, the HLB of the system lying in the range 9.5–11.5. The system is otherwise free of alkoxylated nonionic surfactants.

Nonionic surfactant systems of the above described type are produced by ethoxylating a suitable alcohol to less than the desired degree with a base catalyst and then stripping off the unethoxylated alcohol and lower ethoxylates to give a product having the desired ethoxylate distribution.

A preferred material of this type is formed by ethoxylates of Neodol 23, (a primary $C_{12}$–$C_{13}$ OXO alcohol sold by Shell Chemical Company and containing approximately 10% 2-methyl branching) to give a product containing three ethylene oxide groups per mole of alcohol followed by stripping to remove unethoxylated alcohol and lower ethoxylates. Approximately 34% by weight of the ethoxylate is removed and the residue has a level of ethoxylation of $\approx$4.9 moles per mole of alcohol and an HLB of 10.55.

The present process of mixing alkoxylated nonionic materials with clay is particularly useful when mixtures of the aforesaid surfactants and co-surfactants are to be used in a crutcher mix. The nonionic co-surfactants have low molecular weights, as compared with the surfactants, and tend to volatilize. Sorption on the clay reduces the volatility of the low molecular weight nonionics and allows them to be added to the hot crutcher mix and later spray-dried without excessive evaporative losses.

C. Clay

The clay materials useful in the present compositions and processes are certain kaolinites and bentonites. Kaolinite clay is well-recognized as a light colored, powdery mineral having the approximate formula $$Al_2O_3.SiO_2.2H_2O$$

and a specific gravity of about 2.6. The kaolinites useful in the present invention are naturally derived, i.e., they are not synthetic minerals and in consequence often contain minor proportions (<2%) of iron, calcium, magnesium and titanium oxides which are of no consequence in the present invention. The kaolinites may be subjected to special processing e.g. by calcining or may be surface modified with inorganic materials such as alumina but it has been found that treatment with organic modifying agents does not provide satisfactory material. The kaolinite clays should have a mean particle size of less than about 1 micron, preferably less than 0.5 microns and preferred clays also have a specific surface of at least 10 $m^2$/gram; most preferably at least 15 $m^2$/gram.

Because kaolinite clays are non-swelling in character, their particle size in the dry state is substantially the same as that in the wet (dispersed) state. In this context, particularly useful commercially available kaolinite clays are those which are treated by the so-called "wet process" i.e. are purified by a water washing procedure and are accordingly in a "dispersed" form.

Specific, non-limiting examples of commercial kaolinite clays are useful herein include Hydrite 10, Kaophile 2 and Hydrite UF, all available from the Georgia Kaolin Company, and Hydrasperse and Hydrasheen 90, available from the J. M. Huber Corporation.

The bentonite clays of this invention have the following approximate formula $$[(Al_{4-x}Mg_x)Si_8O_{20}(OH)_4]^{x-}\ [x/n\ M^{n+}]$$

where x=0.5–1.0 and M=$Na^+$ or $Ca^{++}$.

Such materials in the calcium form are a well-known class of minerals that are available from natural sources. These calcium clays are preferred herein. The sodium form of the clay is obtained from the natural calcium form by known methods, e.g., ion exchange. Maximum acceptable particle sizes for bentonite clays in the dry state are difficult to establish by reason of the swelling and dispersion characteristics of this type of clay in solution. However, in order to obtain the maximum benefit, the dry clay should be as fine as possible, i.e. of average particle size less than about 75$\mu$, preferably less than about 45$\mu$. It is known that bentonite clays disperse in solution to give much finer particle sizes and in fact phosphate salts are used commercially to aid the dispersion of laminar clays. Consequently, it is believed that, in the phosphate-containing detergent slurry, swelling bentonite clays are dispersed to particle sizes in the same range as the aforementioned kaolinite clays. Also preferred are bentonites with higher net negative charge (i.e., higher substitution of $Mg^{++}$ and $Ca^{++}$ for $Al^{+++}$ in the matrix).

Examples of commercially available clays are CECA KC-1 and 2 from CARBONIFATION et CHARBONS. ACTIFS of France; Thixogel No. 1 and yellow Texas calcium bentonite (known as Soft Clark) from the Georgia Kaolin Company; and Superventilata, from Industria Mineraria of Italy. Highly preferred is Bentonite L, a calcium exchanged bentonite available from the Georgia Kaolin Company.

A qualitative guide as to the suitability of any particular clay mineral for the purposes of the invention can be obtained by centrifuging a tube of a nonionic-containing crutcher mix incorporating the clay mineral at a temperature of approximately 150° F. If the mineral is satisfactory for the purposes of the invention, it will form a layer between the organic and aqueous phases, and will not migrate completely to the bottom of the tube. This intermediate layer forms when the surface attractive forces on a particle at the interface between the organic and aqueous phases are sufficiently great to overcome the normal gravitational forces exerted on the clay particles which have specific densities in the range of 2.4–2.6. Expressed another way, the surface area of the clay per unit weight is sufficiently great to permit the particles to be held at the organic-aqueous interface by interfacial forces.

D. Processing

The manner in which the present process is carried out depends on the presence or absence of anionic surfactants in the crutcher mix, as noted hereinabove. When anionic surfactants are not used in the crutcher mix, the process herein is somewhat simplified in that a pre-slurry of the nonionic and the clay is not required, but is preferred.

In general terms, the process herein is carried out by preparing a detergent crutcher mix comprising the various components which are to be present in the final detergent composition in an aqueous medium. When there are no anionic surfactants present in the mixture, the clay and nonionic surfactant are simply added to the crutcher mix which is preferably maintained at at temperature of about 150° F., and higher, and dried to form a granular product.

For most purposes, an anionic surfactant will be present in the detergent crutcher mix and this occasions the need for pre-slurrying the clay and nonionic surfactant prior to addition to the crutcher mix. The various processing aspects are set forth in detail in the following examples which are typical of the detergent compositions prepared in the manner of the present invention, but are not intended to be limiting thereof.

EXAMPLE I

The following illustrates a lab-scale test which was used to determine the effect of various additives on the homogeneity of detergent crutcher mixes. In order to visually observe the phases of the crutcher mix, a soluble yellow-green dye, D&C Green No. 8, and a dispersible blue pigment, ultramarine blue, were added to the crutcher mix. When any perceptible phase separation occurred, the yellow dye preferentially dissolved in the surfactant-rich phase and the blue pigment remained in the aqueous/electrolyte phase. By following this procedure, even minor inhomogeneity problems could be visualized as a change in color or texture of the mix. Severe phase separation problems were readily visualized as a yellow streaking or filming even during mixing. The stability of the crutcher mix could be further assessed by allowing the mix to stand, without stirring, and visually observing the separation of the colored phases.

The composition of the crutcher mix varied in each test, depending on whether the proposed stabilizing ingredient was pre-slurried with the nonionic surfactant component or added directly to the crutcher mix. In the former case, 180 grams of a representative nonionic surfactant (Tergitol 15-S-9) was pre-slurried with the stabilizing ingredient being tested at a weight ratio of nonionic surfactant:stabilizing ingredient of 3.6:1, at a temperature of ca. 150° F.–160° F. In the latter case, 180 grams of the Tergitol 15-S-9 was simply admixed with the remaining components of the crutcher mix and the stabilizing ingredient to be tested was added to the total crutcher mix to provide a weight ratio of nonionic surfactant:added stabilizing ingredient of 3.6:1.

The composition of the crutcher mix, exclusive of the nonionic surfactant and stabilizing ingredient being tested was as follows:

| | Grams |
|---|---|
| Sodium silicate ($SiO_2$:$Na_2O$ = 2.0:1.0; solution at 56% water) | 227 |
| Sodium sulfate | 390 |
| Sodium carbonate | 250 |
| Water | 150 |

The results of the series of tests employing a variety of added particulate stabilizing ingredients are set forth in Table II.

Table II

| CRUTCHER HOMOGENETIY | | |
|---|---|---|
| Ingredient | Mode of Addition | Result |
| Kaolinite Clay[1] | Directly to Crutcher | Good |
| Kaolinite Clay[1] | Hot Pre-Slurry | Excellent |
| Bentonite Clay[2] | Hot Pre-Slurry | Moderate |
| Bentonite Clay[2] | Directly to Crutcher | Moderate |
| Attapulgite Clay | Directly to Crutcher | No Effect |
| Attapulgite Clay | Hot Pre-Slurry | No Effect |
| Calcium Silicate | Directly to Crutcher | No Effect |
| Calcium Silicate | Hot Pre-Slurry | No Effect |
| Calcium Carbonate | Directly to Crutcher | Moderate |
| Calcium Carbonate | Hot Pre-Slurry | Moderate |
| Sodium Aluminosilicate | Directly to Crutcher | No Effect |
| Sodium Aluminosilicate | Hot Pre-Slurry | No Effect |
| Aluminum Silicate | Directly to Crutcher | Moderate |
| Aluminum Silicate | Hot Pre-Slurry | Moderate |
| Alumina | Directly to Crutcher | No Effect |

Table II-continued

| CRUTCHER HOMOGENETIY | | |
|---|---|---|
| Ingredient | Mode of Addition | Result |
| Alumina | Hot Pre-Slurry | No Effect |
| Magnesium Silicate | Directly to Crutcher | No Effect |
| Magnesium Silicate | Hot Pre-Slurry | No Effect |
| Silica* | Directly to Crutcher | No Effect |
| Silica* | Hot Pre-Slurry | No Effect |

[1]Hydrite 10
[2]Bentolite L
*A variety of colloidal and amorphous silicas were tested with similar results.

As can be seen from the results in Table II, kaolinite clay is superior to the other materials tested for the purpose of providing crutcher homgeneity. Moreover, the preferred use of a hot pre-slurry of the kaolinite and nonionic surfactant is clearly demonstrated.

Table II also shows that bentonite clay provided some benefit in preparing homogeneous crutcher mixes but an appreciable effect is only obtained when high (25%–60% wt.) concentrations of phosphate builders are present in the crutcher mix. When such high phosphate concentrations are present kaolinite is not particularly effective.

In the foregoing example, the crutcher mix is modified by the addition of 15% wt. of sodium linear alkylbenzene sulfonate (alkyl=$C_{11}$–$C_{14}$) and the crutcher mix temperature is varied. The nonionic surfactant and kaolinite clay are added to the anionic surfactant containing crutcher mix, with the following results: no pre-slurry (poor homogeneity); hot (150° F.) pre-slurry of kaolinite and nonionic added to cool crutcher mix (poor homogeneity); hot (150° F.) pre-slurry of kaolinite and nonionic surfactant added to hot (150° F.) crutcher slurry (substantially improved homogeneity).

EXAMPLE II

Two detergent mixes hereinafter referred to as A and B were prepared with the following compositions expressed as parts by weight.

| | A | B |
|---|---|---|
| Sodium $C_{11.8}$ linear alkyl benzene sulfonate | 73.9 | 73.9 |
| Sodium tallow alkyl sulfate (blend of 55% TAS, 45% LAS as 27.0% aqueous slurry) | | |
| Sodium silicate ($SiO_2$:$Na_2O$= 2.0:1) (as 44% aqueous slurry) | 227.3 | 227.3 |
| Sodium toluene sulfonate | 10.0 | 20.0 |
| Sodium sulfate | 172.0 | 281.0 |
| Water (calculated to give 35% mix moisture content) | 329.0 | 340.8 |
| Tergitol 15-S-9 | 80.0 | 80.0 |
| Tergitol 13-S-5 | 120.0 | 120.0 |
| Clay | 65.0 | 65.0 |
| Miscellaneous | 28.8 | 28.8 |
| Sodium carbonate | 250.0 | — |
| Calcium carbonate | 90.0 | — |
| Sodium Tripolyphosphate | — | 244.0 |
| | 1446.0 | 1480.8 |

In each instance the mixes were made up at a temperature of 140° F.–150° F. and the order of addition of the ingredients was as shown above with the clay and miscellaneous ingredients (brightening agents, colors, antiredeposition agents) being added as a hot slurry (150° F.–160° F.) in the two nonionic surfactants. Two samples of mix A were prepared which were respectively added:

(1) Hydrite 10 (a kaolinite clay) manufactured by Georgia Kaolin Co.

(2) Bentolite L, (a calcium bentonite) also manufactured by Georgia Kaolin Co.

Six separate samples of Mix B were prepared to which the following four kaolinite clays and two bentonite clays were respectively added:

(1) Hydrasperse 90 manufactured by the J. M. Huber Co.

(2) Hydrite 10 manufactured by the Georgia Kaolin Co.

(3) Glomax LL manufactured by the Georgia Kaolin Co.

(4) Hydrasheen 90 manufactured by the J. M. Huber Co.

(5) Soft Clark (calcium bentonite) manufactured by the Georgia Kaolin Co.

(6) Thixogel No. 1 (sodium montmorillonite) manufactured by Georgia Kaolin Co.

Each mix was examined visually under conditions of high and low speed agitation, the latter representing the conditions employed in conventional full scale detergent processing equipment.

Results were as follows:

| | MIX A | | MIX B | | | | | |
|---|---|---|---|---|---|---|---|---|
| | (1) | (2) | (1) | (2) | (3) | (4) | (5) | (6) |
| High Agitation | smooth; continuous aqueous phase | lumpy; continuous aqueous phase | lumpy; continuous aqueous phase | continuous aqueous phase | continuous organic phase | continuous aqueous phase | continuous aqueous phase | continuous aqueous phase |
| Low Agitation | smooth; continuous aqueous phase | lumpy; continuous aqueous phase nonionic separation on standing | nonionic separation | nonionic separation | — | nonionic separation | continuous aqueous phase | smooth; continuous aqueous phase |

It can be seen that the use of a kaolinite clay in a phosphate-free detergent mix (1) or a bentonite clay in a phosphate-containing mix (5,6) permits the production of a smooth mix in which the aqueous phase is continuous (thereby permitting spray drying of a non-sticky granular product). In contrast the use of a variety of kaolinites in a phosphate-containing detergent mix promotes phase separation and in some instances even phase inversion, which prevents the spray drying of a satisfactory granular product. Similarly, the incorporation of a bentonite clay into a non-phosphate detergent mix did not prevent the ultimate separation of the nonionic surfactant although it did provide a marginal benefit in line with the observations in Table II which were based on a non-phosphate crutcher mix.

The following example illustrates the preparation of a granular detergent composition in the manner of the present invention. In the process, sodium toluene sulfonate is employed as a hydrotrope in the crutcher mix and further aids in the maintenance of crutcher homogeneity when employed in combination with the hot pre-slurry procedure herein.

EXAMPLE III

| Crutcher Mix | |
|---|---|
| Ingredient | Grams |
| Sulfated tallow alcohol | 2.0 |
| Linear alkylbenzene sulfonate (alkyl = $C_{11.8}$ avg.) | 2.0 |
| Calcium carbonate (1.0 micron) | 9.0 |
| Sodium carbonate | 30.0 |
| Sodium sulfate | 9.7 |
| Sodium sulfosuccinate | 2.0 |
| Sodium toluene sulfonate | 2.0 |
| Sodium silicate ($SiO_2$:$Na_2O$ = 2.0) | 10.0 |
| Water | 45.0 |

| Pre-Slurry | |
|---|---|
| Ingredient | Grams |
| Tergitol 15-S-9 | 10.0 |
| Tergitol 15-S-3 | 10.0 |
| Kaolinite clay | 6.5 |

Following the procedure set forth hereinabove, the kaolinite clay and the nonionic surfactants are admixed separately from the crutcher at a temperature of 150° F. and blended thoroughly at this temperature for about 5 minutes until a smooth slurry is obtained. The crutcher mix ingredients are separately mixed and raised to a temperature of 150° F. The hot kaolinite-nonionic slurry is then admixed with the hot crutcher mix and blended. A homogeneous crutcher mix suitable for spray-drying is obtained. The hot total mixture is introduced into a spray-dry tower and sprayed to provide a granular detergent composition.

In the foregoing example, the sodium toluene sulfonate hydrotrope is replaced by an equivalent amount of sodium m-xylene sulfonate, sodium o-xylene sulfonate, sodium p-xylene sulfonate and mixed sodium cumene sulfonate hydrotropes, respectively, and equivalent results are secured. The use of such hydrotroping materials at concentrations of from about 0.1% to about 5% by weight in the crutcher mixes herein, which results in detergent compositions containing from about 0.3% to about 7.0% by weight of said hydrotropes, aids in the formation of homogeneous, easily-worked crutcher mixes when employed in combination with the kaolinite clay in the manner of the present invention.

In the foregoing example, the 1:1 mixture of Tergitol 15-S-3 and Tergitol 15-S-9 employed in the pre-slurry is replaced by an equivalent amount of n-$C_{10}$EO(3)/n-$C_{10}$EO(9) 60:40 wt. ratio; n-$C_{10}$EO(3)/n-$C_{10}$EO(9) 65:35 wt. ratio; n-$C_{10}$EO(3)/n-$C_{10}$EO(6) 1:1 wt. ratio;

n-$C_{10}$EO(3)/Tergitol 15-S-9 55:45 wt. ratio; and n-$C_{10}$EO(4)/Tergitol 15-S-7 60:40 wt. ratio, respectively, and equivalent results are secured.

In the foregoing example, the anionic surfactant component of the crutcher mix comprising the sulfated tallow alcohol and the linear alkylbenzene sulfonate is replaced by an equivalent amount of sodium linear $C_{10}$–$C_{18}$ alkylbenzene sulfonate; triethanolamine $C_{10}$–$C_{18}$ alkylbenzene sulfonate; sodium tallow alkyl sulfate; sodium coconut alkyl glycerylether sulfonate; the sodium salt of a sulfated condensation product of a tallow alcohol containing from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)-hexanoate; dodecyl dimethyl amine oxide; coconutalkyldimethyl amine oxide; and the water-soluble sodium and potassium salts of higher fatty acids containing 8 to 24 carbon atoms, respectively, and equivalent results are secured.

In the foregoing example the seeded builder comprising the mixture of sodium carbonate and calcium carbonate is replaced by a total of 40 grams of the following builders, respectively: sodium tripolyphosphate; sodium nitrilotriacetate; sodium citrate; sodium oxydisuccinate; sodium mellitate; sodium ethylenediaminetetraacetate; sodium carboxymethyloxymalonate; sodium carboxymethyloxysuccinate; sodium cis-cyclohexanehexacarboxylate; sodium cis-cyclopentanetetracarboxylate; and the sodium salt of phloroglucinol trisulfonate.

In every instance except for the replacement by sodium tripolyphosphate equivalent results are secured. If, in the STP-containing product the kaolinite is replaced by an equivalent amount of bentonite, homogeneous compositions are secured.

The following example illustrates the use of gelling agents in the present compositions and processes to provide a dry detergent granule having a decreased tendency to bleed nonionic surfactant.

EXAMPLE IV

| Crutcher Mix | |
|---|---|
| Ingredient | Grams |
| Sulfated tallow alcohol | 5.0 |
| Linear alkylbenzene sulfonate (alkyl = $C_{11.8}$ avg.) | 5.0 |
| Sodium sulfate | 6.0 |
| Sodium sulfosuccinate | 2.0 |
| Sodium silicate ($SiO_2$:$Na_2O$ = 2.0) | 15.0 |
| Colorants, optical brighteners | 1.3 |
| Water | 25.0 |

| Pre-slurry | |
|---|---|
| Ingredient | Grams |
| Coconut alcohol ethoxylate (6) | 20.0 |
| Kaolinite clay | 5.0 |
| Hydroxybutylcellulose | 0.2 |

The crutcher mix ingredients are separately blended and raised to a temperature of 150° F.–155° F. The clay and coconut ethoxylate nonionic surfactant are admixed in the pre-slurry and the temperature raised to 150° F. The materials are blended for about 5 minutes to provide a creamy consistency. The hydroxybutylcellulose is then mixed with the pre-slurry and blending is continued for an additional 10 minutes at 150° F. The hot pre-slurry is added to the hot crutcher mix and blended to provide a homogeneous system. The hot total mix is then introduced into a drying column and sprayed through a column of air at a temperature of about 200° F. to provide spray-dried granules. On storage, the granules prove to be crisp and free-flowing, and possess superior storage properties in that they demonstrate improved retention of the nonionic surfactant.

In the foregoing example the hydroxybutylcellulose is replaced by an equivalent amount of powdered amorphous silica, hydroxyethylcellulose, hydroxypropylcellulose, methylcellulose, and ethylcellulose, respectively, and equivalent results are secured.

As can be seen by the foregoing examples, the processes of the present invention result in superior detergent compositions characterized by their ease of processing.

EXAMPLE V

| EXAMPLE V | |
|---|---|
| Ingredient | Wt.% |
| Sulfated tallow alcohol | 2.0 |
| Linear alkylbenzene sulfonate (alkyl = $C_{11.8}$ avg.) | 2.0 |
| Nonionic surfactant (1:1 wt. mixture of Tergitol 15-S-9 and Tergitol 15-S-3) | 20.0 |
| Kaolinite clay (0.5 micron diam.) | 6.5 |
| Calcium carbonate (1 micron diam.) | 9.0 |
| Sodium carbonate | 30.0 |
| Sodium sulfate | 9.7 |
| Sodium sulfosuccinate | 2.0 |
| Sodium toluene sulfonate | 2.0 |
| Sodium silicate ($SiO_2$:$Na_2O$ = 2.0) | 10.0 |
| Colorants, optical brighteners | 1.3 |
| Water | 3.5 |
| Total spray-dried granules | 98.0 |
| Dry powder admix* | 2.0 |
| Total | 100.0% |

*Powdered amorphous silica dusted onto spray-dried granules as a free-flow aid.

The foregoing composition is prepared by pre-slurrying the nonionic surfactant with kaolinite clay at a temperature of about 150° F. and adding the pre-slurry to a crutcher mix at 150° F., followed by spray-drying. When the procedure is carried out at pre-slurry and crutcher mix temperatures of 160° F., 170° F. and 210° F., respectively, equivalent detergent compositions are secured.

The composition of Example IV is modified by replacing the mixture of sulfated tallow alcohol and linear alkylbenzene sulfonate with an equivalent amount of the anionic detergent mixtures set forth herein in Table I, and equivalent results are secured.

EXAMPLE VI

Spray-dried products identified below as A and B were prepared with the following compositions:

| | Wt. % | | |
|---|---|---|---|
| Ingredient | A | B | C |
| Neodol 23-3T* | 11.0 | 11.0 | 11.0 |
| Sodium tripolyphosphate | 32.0 | — | 7.0 |
| Carboxymethylcellulose | 0.48 | 0.48 | — |
| Sodium sulfate | 11.6 | 26.7 | 31.0 |
| Bentonite clay (Bentolite L) | 5.0 | — | — |
| Kaolinite clay | | | |

-continued

| Ingredient | Wt. % A | B | C |
|---|---|---|---|
| (Hydrasheen 90) | — | 15.0 | 7.0 |
| Sodium silicate ($SiO_2$: $Na_2O$=1.6:1) | 5.9 | 5.9 | 10.0 |
| Miscellaneous | 1.02 | 1.02 | 1.0 |
| Water | 7.0 | 7.0 | 7.0 |
| | 74.0 | 67.1 | 74.0 |
| Admixed sodium sulfate | 26.0 | — | — |
| Admixed sodium tripolyphosphate | — | 32.9 | 26.0 |
| | 100.0 | 100.0 | 100.0 |

*A $C_{12}$–$C_{13}$ linear oxo alcohol ethoxylated to give three moles ethylene oxide per mole alcohol and then stripped of unethoxylated alcohol and lower ethoxylates to leave a product of degree of ethoxylation = 4.9.

The foregoing compositions were prepared by directly adding all of the components separately to the crutcher in the order indicated at a crutcher mix temperature of about 150° F. In each case the resulting mix was homogeneous and was spray dried in a tower with an inlet air stream of 600° F. to provide satisfactory detergent granules.

A crutcher mix was also prepared to provide a spray-dried composition having the formulation C. The same procedure was used but on addition of the nonionics to the crutcher mix, the ingredients separated to give an ethoxylate-rich upper layer and a lower viscous layer containing the remaining materials. The mixture could not be spray dried.

As can be seen by the disclosures hereinabove, the present invention constitutes a significant improvement in the preparation of detergent granules containing alkoxylated nonionic surfactants which comprises adding kaolinite or bentonite clay to a crutcher mix in the ratios and proportions set forth. In a preferred mode, the nonionic surfactant is separately sorbed on the clay at a temperature of from 150° F. to 180° F. before addition to the hot crutcher mix. Thermogravimetric analyses show that the kaolinite clays employed as disclosed herein substantially and consistently decrease the loss of nonionic surfactants by volatilization in a hot (210° F.–650° F.) spray-drying tower. Additional advantages are secured by using various gelling agents and/or hydrotropes in the process, in the manner described.

What is claimed is:

1. A homogeneous, spray-dried granular detergent composition consisting essentially of:

(a) from about 0.5% to about 40% by weight of a naturally derived clay mineral selected from the group consisting of kaolinites having a mean particle size of not more than about 1μ and bentonites having a mean particle size of not more than about 75μ and being substantially free of organic modifying groups;

(b) from about 2% to about 60% by weight of an alkoxylated nonionic surfactant or mixtures of said alkoxylated nonionic surfactants, said surfactant and said clay being in a weight ratio lying in the range of from about 6:1 to about 1:2, and (c) from 5% to about 50% by weight of a detergency builder selected from the group consisting of alkali metal, ammonium and substituted ammonium organic and inorganic builder salts said builder salts and said clay mineral being selected so than when said detergency builder is a phosphate salt, said clay is a bentonite clay, and when said detergency builder is non-phosphatic in character, said clay is a kaolinite clay.

2. A composition according to claim 1 wherein the weight ratio of nonionic surfactant to clay is from about 3:1 to about 1:1.

3. A composition according to claim 1 wherein the nonionic surfactant is mixed with the clay at a temperature of from 150° F. to 210° F.

4. A composition according to claim 3 containing, as an additional component, from about 1% to about 50% by weight of a member selected from the group consisting of anionic, semi-polar, zwitterionic and amphoteric water-soluble detergent compounds.

5. A composition according to claim 4 wherein the detergent compound is a member selected from the group consisting of sodium linear $C_{10}$–$C_{18}$ alkylbenzene sulfonate; triethanolamine $C_{10}$–$C_{18}$ alkylbenzene sulfonate; sodium tallow alkyl sulfate; sodium coconut alkylglycerylether sulfonate; the sodium salt of a sulfated condensation product of a tallow alcohol with from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)hexanoate; dodecyl dimethyl amine oxide; coconutalkyl dimethyl amine oxide; and the water-soluble sodium and potassium salts of higher fatty acids containing 8 to 24 carbon atoms.

6. A composition according to claim 4 wherein the detergent compound is an alkyl ether sulfate comprising from about 0.05% to 5% by weight of a mixture of $C_{12-13}$ compounds, from about 55% to 70% by weight of a mixture of $C_{14-15}$ compounds, from about 25% to 40% by weight of a mixture of $C_{16-17}$ compounds and from about 0.1% to 5% by weight of a mixture of $C_{18-19}$ compounds, said mixture further characterized as comprising from about 15% to 25% by weight of a mixture of compounds having a degree of ethoxylation of 0, from about 50% to 65% by weight of a mixture of compounds having a degree of ethoxylation from 1 to 4, from about 12% to 22% by weight of a mixture of compounds having a degree of ethoxylation from 5 to 8 and from about 0.5% to 10% by weight of a mixture of compounds having a degree of ethoxylation greater than 8.

7. A composition according to claim 4 wherein the detergent compound comprises an α-olefin sulfonate mixture consisting essentially of from 30% to about 70% by weight of water-soluble salts of alkene-1-sulfonic acids, from about 20% to about 70% by weight of water-soluble salts of 3, 4, and 5 hydroxyalkane sulfonates and from about 2% to about 15% of alkene disulfonates and hydroxy alkane disulfonates.

8. A composition according to claim 1 wherein the detergency builder is present in an amount of at least 5%.

9. A composition according to claim 8 wherein the detergency builder is selected from the group consisting of water-soluble alkali metal, ammonium and substituted ammonium inorganic builder salts.

10. A composition according to claim 8 wherein the detergency builder is selected from the group consisting of water-soluble alkali metal ammonium and substituted ammonium organic builder salts.

11. A composition according to claim 8 wherein the detergency builder is selected from the group consisting of sodium carbonate, sodium sesquicarbonate and sodium aluminate in combination with a crystallization seed which is selected from the group consisting of finely divided calcium carbonate, calcium hydroxide and calcium oxide.

12. A composition according to claim 1 containing, as an additional component, from about 0.1% to about 5% by weight of a gelling agent selected from the group consisting of microfine silicas and alkyl and hydroxyalkyl cellulose derivatives.

13. A composition according to claim 1 further incorporating from about 1% to about 50% by weight of the composition of a water soluble detergent builder salt selected from the group consisting of alkali metal ammonium and alkanolammonium organic and inorganic detergent builder salts, said builder salt being admixed with said homogeneous granular detergent.

14. A composition according to claim 1, comprising:

(a) from about 1% to about 10% by weight of kaolinite clay;

(b) from about 5% to about 35% of a base catalyzed ethoxylated $C_9$–$C_{15}$ primary alcohol having at least 65% by weight of the alkyl residue within ±1 carbon atoms of the mean and having a degree of ethoxylation between 3.5 and 6.5, there being <5% by weight of unethoxylated alcohol and at least 63% by weight of ethoxylates having a degree of ethoxylation from 2–7 inclusive, the HLB of the ethoxylate lying within the range 9.5–11.5;

(c) from about 1% to about 50% by weight of a water-soluble, anionic detergent compound; and (d) from about 5% to about 50% by weight of a non-phosphate detergency builder.

15. A composition according to claim 14 containing, as an additional component, from about 0.1% to about 5% by weight of a gelling agent selected from the group consisting of microfine silicas, alkyl cellulose derivatives and hydroxyalkylcellulose derivatives.

16. A composition according to claim 15 wherein the gelling agent is selected from the group consisting of hydroxybutylcellulose and hydroxypropylmethylcellulose.

17. A composition according to claim 14 containing, as an additional component, from about 0.3% to about 7% by weight of a hydrotrope.

18. A composition according to claim 17 wherein the hydrotrope is sodium p-toluene sulfonate.

19. A composition according to claim 1, comprising:

(a) from about 1% to about 10% by weight of a bentonite clay mineral having a mean particle size of not more than about 45 microns;

(b) from about 5% to about 35% of a base catalyzed ethoxylated $C_9$–$C_{15}$ primary alcohol having at least 65% by weight of the alkyl residue within ±1 carbon atoms of the mean and having a degree of ethoxylation between 3.5 and 6.5, there being <5% by weight of unethoxylated alcohol and at least 63% by weight of ethoxylates having a degree of ethoxylation from 2–7 inclusive, the HLB of the ethoxylate lying within the range 9.5–11.5;

(c) from about 1% to about 50% by weight of a water-soluble, anionic detergent compound; and (d) from about 5% to about 50% by weight of an alkali metal phosphate detergency builder.

20. In a process for preparing a homogeneous, spray-dried detergent granule containing from about 2% to about 60% by weight of alkoxylated nonionic surfactants comprising the steps of:

(a) preparing a 150° F. to 210° F. crutcher mix containing the granule components; and (b) spray-drying said crutcher mix, the improvement which comprises adding a naturally derived clay mineral selected from the group consisting of kaolinites having a mean particle size of not more than about 1 micron and bentonites having a mean particle size of less than about 75 microns to said crutcher mix to provide a nonionic surfactant:clay ratio of from 6:1 to 1:2, said clay mineral having a mean particle size of not more than about 1 micron and being substantially free of organic modifying groups.

21. A process according to claim 20 wherein the nonionic surfactant is mixed with the clay at a temperature of 150° F. to 210° F. and added to the crutcher mix.

* * * * *

UNITED STATES PATENT AND TRADEMARK OFFICE

CERTIFICATE OF CORRECTION

PATENT NO. : 4,166,039

DATED : August 28, 1979

INVENTOR(S) : Rodney M. Wise

It is certified that error appears in the above-identified patent and that said Letters Patent are hereby corrected as shown below:

Column 5, line 49, "5μ" should be -- 45μ --

Column 8, line 42, "As" should be -- An --.

Column 9, line 36, "3-4-5-hydroxy" should be -- 3-4-& 5-hydroxy --

Signed and Sealed this

Eighteenth Day of December 1979

[SEAL]

Attest:

SIDNEY A. DIAMOND

Attesting Officer

Commissioner of Patents and Trademarks